US005990066A

United States Patent [19]

Gordon et al.

[11] Patent Number: 5,990,066

[45] Date of Patent: Nov. 23, 1999

[54] LIQUID HARD SURFACE CLEANING COMPOSITIONS BASED ON CARBOXYLATE-CONTAINING POLYMER AND DIVALENT COUNTERION, AND PROCESSES OF USING SAME

[75] Inventors: Neil James Gordon, Strombeek-Bever; Vincent Reniers, Tienen, both of Belgium; Alan David Willey, Cincinnati, Ohio

[73] Assignee: The Procter & Gamble Company, Cincinnati, Ohio

[21] Appl. No.: 09/101,072

[22] PCT Filed: Dec. 29, 1995

[86] PCT No.: PCT/US95/17044

§ 371 Date: Jun. 12, 1998

§ 102(e) Date: Jun. 12, 1998

[87] PCT Pub. No.: WO97/24425

PCT Pub. Date: Jul. 10, 1997

[51] Int. Cl.[6] ..... C11D 3/02; C11D 3/22; C11D 3/37

[52] U.S. Cl. ..... 510/238; 510/244; 510/434; 510/471; 510/476; 510/508

[58] Field of Search ..... 510/434, 223, 510/471, 476, 508, 533, 238, 244

[56] References Cited

U.S. PATENT DOCUMENTS

| | | | |
|---|---|---|---|
| 3,960,575 | 6/1976 | Martin | 106/10 |
| 4,218,250 | 8/1980 | Kasprzak | 106/3 |
| 4,692,264 | 9/1987 | Gresser | 510/418 |
| 4,784,786 | 11/1988 | Smith et al. | 252/91 |
| 5,314,636 | 5/1994 | Rek et al. | 510/371 |
| 5,486,307 | 1/1996 | Misselyn et al. | 510/108 |
| 5,510,052 | 4/1996 | McCandlish | 510/218 |
| 5,574,004 | 11/1996 | Carr | 510/361 |
| 5,739,092 | 4/1998 | Ofusu-Asante | 510/235 |

FOREIGN PATENT DOCUMENTS

| | | | |
|---|---|---|---|
| 0 100 125 | 2/1984 | European Pat. Off. . | |
| 0 162 033 A2 | 11/1985 | European Pat. Off. | C11D 3/386 |
| 0 374 471 A1 | 6/1990 | European Pat. Off. | C11D 1/94 |
| 71 478 | 12/1974 | Luxembourg . | |
| 1 430 204 | 3/1976 | United Kingdom | C11D 7/22 |
| WO 93/05132 | 3/1993 | WIPO | C11D 1/65 |
| 94/05769 | 3/1994 | WIPO . | |
| WO 94/05752 | 3/1994 | WIPO | C11D 1/10 |
| WO 94/12609 | 6/1994 | WIPO | C11D 10/04 |
| WO 94/26858 | 11/1994 | WIPO | C11D 1/72 |
| 95/14762 | 6/1995 | WIPO . | |

*Primary Examiner*—Ardith Hertzog
*Attorney, Agent, or Firm*—Robert B. Aylor

[57] ABSTRACT

Liquid hard-surface cleaning compositions are disclosed which provide excellent gloss to the surfaces cleaned therewith. The compositions comprise a surfactant, a carboxylate-containing polymer, and a divalent counterion in a molar ratio of carboxylate-containing monomeric units in said polymer to said divalent counterion of from about 12:1 to 1:32.

30 Claims, No Drawings

LIQUID HARD SURFACE CLEANING COMPOSITIONS BASED ON CARBOXYLATE-CONTAINING POLYMER AND DIVALENT COUNTERION, AND PROCESSES OF USING SAME

TECHNICAL FIELD

The present invention relates to compositions for cleaning hard-surfaces, especially in-house hard-surfaces.

BACKGROUND

A variety of compositions for cleaning hard-surfaces have been disclosed in the art. Much of the focus for such compositions has been on providing outstanding cleaning on a variety of surfaces and soils. For some specialised cleaners, such as glass cleaners, much effort has additionally been devoted to the formulation of so-called "streak-free" products, i.e. products which leave no or little visible residues after use.

The object of the present invention is to formulate hard-surface cleaning compositions which clean and provide gloss to the cleaned surface. That is different from a "streak-free" composition, in that gloss additionally requires improved reflectance of light from the cleaned surface. A variety of products are commercially available for delivering gloss to surfaces, and they are disclosed for instance in U.S. Pat. No. 3,960,575 and U.S. Pat. No. 4,218,250. Both references recommend the use of various silicones for delivering gloss. Such compositions are not fully formulated hard-surface cleaners, so that they do not clean efficiently, and indeed the formulation of silicone in hard-surface cleaners has not shown any gloss benefits. See for instance EP 374 471 which discloses a hard-surface cleaning composition with, amongst other essentials, a silicone for improved resistance to soil redeposition.

We have now found that superior gloss on surfaces can be obtained by formulating liquid compositions comprising a surfactant, a carboxylate-containing polymer and a divalent counterion in a molar ratio of said polymer to said divalent counterion of from 12:1 to 1:32. Indeed, it has been found that said compositions provide excellent cleaning performance on different types of stains including typical greasy stains while delivering improved gloss and less surface streaking/spotting.

An advantage of the present invention is that said compositions may be used to clean in-house hard-surfaces made of a variety of material like glazed and non-glazed ceramic tiles, vinyl, linoleum, melamine, both in diluted and neat conditions.

Another advantage of the process of cleaning hard-surfaces according to the present invention wherein the compositions herein is used in diluted form is that enhanced gloss is provided to the surfaces treated without the need of a subsequent rinsing, thereby facilitating its usage by the consumer.

U.S. Pat. No. 4,784,786 discloses a composition for cleaning glass which can be readily applied to and removed from a soiled glass surface to leave the surface clean and free of streaking and cloudiness. Said compositions comprise amongst other ingredients, surfactants, glycol ether, an anionic polysulfonic acid and an anhydride compound comprising an olefin-maleic anhydride copolymer. No divalent counterions are disclosed.

WO 94/26858 discloses a liquid hard-surface composition (pH 2–8) with nonionic surfactants (1–30%) and anionic polymers having an average molecular weight of less than 1 000 000. Said compositions bring a surprising initial cleaning benefit in addition to the anti-soiling benefit. Indeed, WO 94/26858 discloses that acrylic, methacrylic and maleic anhydride derivatives such as copolymers of styrene with maleic produce a streak-free finish after drying. No divalent counterions are disclosed.

EP-A-658 184 discloses liquid or gel dishwashing detergent compositions containing alkyl amphocarboxylic acid (5%–95%) and magnesium or calcium salts (0.1%–4%), said compositions having a pH in a 10% solution in water at 20° C. of 7 to 10. As optional ingredients said compositions comprise co-surfactants, like nonionic surfactants (5%–95%). No carboxylate-containing polymers are disclosed. Also no hard-surfaces application is disclosed.

EP-A-162 033 discloses heavy-duty liquid detergents comprising proteolytic or amylolytic enzymes, an anionic surfactant (10%–50%), optionally other surfactants like nonionic ethoxylated surfactants (2%–25%), from 1 to 30 millimoles of calcium ions per liter of composition and detergent builders (2%–15%) like polycarboxylates including water-soluble salts of specific polymeric aliphatic polycarboxylic acids (e.g., polymers and copolymers of maleic acid). EP-A-162 033 further discloses that the level of calcium ions should be selected so that there is always some minimum level available for the enzyme, after allowing for complexation with fatty acids and the like in the composition. Sources of calcium ions are for example calcium chloride and/or calcium acetate. No hard-surface application is disclosed.

EP-A-602 179 discloses that the addition of calcium salts to compositions containing a polyhydroxy fatty acid amide, and an anionic surfactant improves the removal of greasy soils while delivering good hand mildness. Indeed, EP-A-602 179 discloses dishwashing compositions comprising an anionic surfactant (3%–95%), a polyhydroxy fatty acid amide (3%–40%) and calcium ions (0.1% to 3%). The compositions have a pH of from 5.5 to 10 in a 10% solution in water at 20° C. As optional ingredients said compositions comprise polycarboxylate polymers having a molecular weight of 750 000 to 4 000 000 (0.1%–10%). No hard-surface cleaning application is disclosed.

EP-A-670 884 discloses fully formulated liquid detergent compositions (pH 7.5–9.5) comprising a polyhydroxy fatty acid amide surfactant (5%–50%), a nonionic (5%–50%), a source of calcium (0.5%–2%) and soap. Optional ingredients are polycarboxylate builders such as copolymers of maleic anhydride with ethylene or vinyl methyl ether and polymeric polycarboxylic dispersing agents (0.1%–7%) that can be prepared by polymerizing or copolymerizing suitable unsaturated monomers including acrylic acid, maleic acid. Acrylic/maleic-based copolymers with a molecular weight of 2 000 to 100 000 are disclosed. No hard-surface application is disclosed.

GB 1430 204 discloses compositions suitable to clean various soiled subtracts including hard-surfaces. Said compositions comprise a polymer (3%–35%) such as acrylic polymers and polycarbonates, optionally metal ions such as calcium or magnesium (0.1%–5%), and builders (0.1%–5%) such as copolymers of vinyl methyl ether and maleic anhydride, and carboxymethyl cellulose. A surfactant may be used as optional but no levels thereof are disclosed, let alone particular classes of surfactants. GB 1 430 204 also discloses a process of cleaning a soiled surface, said process comprising the steps of applying to said surface said composition, allowing said composition to form a tacky film to which soils adhere, allowing said composition to dry, whereby as a result of said drying, said film fractures to form a removable residue and then removing said residue. The presence of the metal ions increases the brittleness of the film.

Actually, the benefit derivable from the use of a surfactant, a carboxylate-containing polymer and a divalent counterion in appropriate molar ratios of said polymer to said divalent counterion, in a liquid hard-surface cleaning composition, i.e. improved gloss to the surfaces treated therewith, has not been acknowledged in the prior art.

SUMMARY OF THE INVENTION

The present invention encompasses a process of cleaning hard-surfaces wherein a liquid composition comprising a carboxylate-containing polymer and a divalent counterion in a molar ratio of said polymer to said divalent counterion of from 12:1 to 1:32 and from 0.1% to 50% by weight of the total composition of a surfactant, is applied onto said surfaces.

The present invention also encompasses a liquid hard-surface cleaning composition comprising a carboxylate-containing polymer and a divalent counterion in a molar ratio of said polymer to said divalent counterion of from 12:1 to 1:32 and from 0.1% to 50% by weight of the total composition of a surfactant, said composition being free of a proteolytic or amylolytic enzyme and of polyhydroxy fatty acid amide.

DETAILED DESCRIPTION OF THE INVENTION

In its broadest aspect, the present invention relates to a process of cleaning hard-surfaces wherein a liquid composition comprising a carboxylate-containing polymer and a divalent counterion in a molar ratio of said polymer to said divalent counterion of from 12:1 to 1:32 and a surfactant, is applied onto said surfaces.

By "hard-surfaces" it is meant herein any kind of in-house hard-surfaces with the exception of dishes and any ustensiles used for the cooking and for eating/drinking. Preferred herein "hard-surfaces" has to be understood as any fixed household hard-surface including floors, walls, windows, fixtures and fittings and the like.

Said liquid composition may be applied to the surface to be cleaned in its neat form or in its diluted form.

By "diluted form" it is meant herein that said liquid composition is diluted by the user typically with water. The composition is diluted prior use to a typical dilution level of 10 to 200 times its weight of water. Usual recommended dilution level is a 1.2% dilution of the composition in water which corresponds to an active level of from 0.01% to 0.5% by weight of the resulting washing solution.

When applying said composition to the surface to be cleaned in its neat form or in a so-called concentrated form (i.e. between 10%–40% total actives), it is necessary to rinse the surface after the composition has been applied, otherwise too many visible residues are left on the surface. In this "concentrated" usage form, however, the gloss benefit provided by the compositions of the present invention is still obtained after fewer rinses than would otherwise be required when using the same composition without said surfactant or the same composition without said polymer and said divalent counterion in a molar ratio of said polymer to said divalent counterion of from 12:1 to 1:32.

In the preferred process of cleaning hard-surfaces according to the present invention where said composition is used in diluted form, there is no need to rinse the surface after application of the composition in order to obtain the gloss benefit.

In one embodiment the present invention is a liquid hard-surface cleaning composition comprising a carboxylate-containing polymer and a divalent counterion in a molar ratio of said polymer to said divalent counterion of from 12:1 to 1:32 and from 0.1% to 50% by weight of the total composition of a surfactant, said composition being free of a proteolytic or amylolytic enzyme and of polyhydroxy fatty acid amide.

As a first essential ingredient, the compositions according to the present invention comprise a carboxylate-containing polymer, or mixtures thereof. By "carboxylate-containing polymer" it is meant herein a polymer or copolymer comprising at least a monomeric unit which contains at least a carboxylate functionality. Any carboxylate-containing polymer known to those skilled in the art can be employed according to the present invention such as homo- or co-polymeric polycarboxylic acids or their salts including polyacrylates and polymers and copolymers of maleic anhydride or/and acrylic acid and the like, or mixtures thereof. Indeed, such carboxylate-containing polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 1,000,000, more preferably from about 10,000 to 150,000 and most preferably from about 20,000 to 100,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred carboxylate-containing polymer. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name SOKALAN CP5.

Other suitable carboxylate-containing polymers to be used herein include cellulose derivatives such as carboxymethylcellulose. For example carboxymethylcellulose may be used as a salt with conventional cation such as sodium, potassium, amines or substituted amines.

As a second essential ingredient, the compositions according to the present invention comprise a divalent counterion, or mixtures thereof. All divalent ions known to those skilled in the art may be used herein. Preferred divalent ions to be used herein are calcium, zinc, cadmium, nickel, copper, cobalt, zirconium, chromium and/or magnesium and more preferred are calcium, zinc and/or magnesium. Said divalent ions may be added in the form of salts for example as chloride, acetate, sulphate, formate and/or nitrate or as a complex metal salt. For example, calcium may be added in the form of calcium chloride, magnesium as magnesium acetate or magnesium sulphate and zinc as zinc chloride.

In one embodiment of the present invention said carboxylate-containing polymer and said divalent counterion may be added as one ingredient provided that the molar ratio of said carboxylate-containing polymer to said divalent counterion/salt is from 12:1 to 1:32.

According to the present invention, said polymer and said divalent counterion are present in the compositions for cleaning hard-surfaces herein in a molar ratio of said polymer to said divalent counterion of from 12:1 to 1:32, preferably of from 8:1 to 1:16, more preferably of from 6:1 to 1:12 and most preferably of from 4:1 to 1:6. Preferred molar ratios of said polymer to said divalent counterion are those where improved gloss is obtained in the most economic way.

By "molar ratio of said polymer to said divalent counterion" it is meant herein the number of moles of carboxylate-containing monomer to the number of moles of divalent ion. For example, in a preferred embodiment of the present invention where said carboxylate-containing polymer is an acrylic acid/maleic acid copolymer the molar ratio is stated as a range based on the theoretical molar ratio of a pure acrylic acid polymer to divalent ions and a pure maleic acid polymer to divalent ions.

Accordingly, the compositions for the cleaning of hard-surfaces according to the present invention comprise from 0.01% to 20% by weight of the total composition of said carboxylate-containing polymer, or mixtures thereof, preferably from 0.1% to 10%, more preferably from 0.1% to 5% and from 0.01% to 4% by weight of the total composition of said divalent counterion, or mixtures thereof, preferably from 0.02% to 2%, and more preferably from 0.02% to 1%.

By "improved gloss" it is meant herein that the gloss observed, when cleaning a hard-surface according to the present invention with a composition comprising a surfactant, a carboxylate-containing polymer and a divalent counterion in a molar ratio of said polymer to said divalent counterion of from 12:1 to 1:32, is improved as compared to the gloss observed when cleaning said surface with the same composition without said surfactant, or with the same composition without said divalent counterion and said carboxylate-containing polymer in a molar ratio of said polymer to said divalent counterion of from 12:1 to 1:32. This gloss improvement is observed in both neat or diluted usage conditions, and especially in the embodiment where the diluted usage is performed with soft water, i.e. a water with a water hardness of less than 10 grains/gallons. This gloss benefit may be evaluated by reflectance as judged by a gloss meter and/or by a visual grading as judged by a panel of graders.

As a third essential ingredient, the compositions according to the present invention comprise a surfactant, or mixtures thereof. Said surfactant is present in the compositions according to the present invention in amounts of from 0.1% to 50% by weight of the total composition, preferably from 0.1% to 20% and more preferably of from 1% to 10%. It is said surfactant which in combination with said polymer and divalent counterion, is deposited on the surface cleaned and contributes to the gloss benefit. Surfactants to be used herein include nonionic surfactants, anionic surfactants, cationic surfactants, amphoteric surfactants, zwitterionic surfactants, and mixtures thereof.

Particularly preferred surfactants are the nonionic surfactants. Suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohols) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. For example, a well-known class of nonionic synthetic detergents is made available on the market under the trade name "Pluronic". These compounds are formed by condensing ethylene oxide with an hydrophobic base formed by the condensation of propylene oxide with propylene glycol. The hydrophobic portion of the molecule which, of course, exhibits water-insolubility has a molecular weight of from about 1500 to 1800. The addition of polyoxyethylene radicals to this hydrophobic portion tends to increase the water-solubility of the molecule as a whole and the liquid character of the products is retained up to the point where polyoxyethylene content is about 50% of the total weight of the condensation product.

Other suitable nonionic synthetic detergents include:

(i) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane;

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000;

(iii) The condensation product of aliphatic alcohols having from 8 to 18 carbon atoms, in either straight chain or branched chain configuration, with ethylene oxide, e.g., a coconut alcohol ethylene oxide condensate having from 10 to 30 moles of ethylene oxide per mole of coconut alcohol, the coconut alcohol fraction having from 10 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; the alkyl groups can contain hydroxy substituents; specific examples are dodecyl di(2-hydroxyethyl) amine oxide and tetradecyl dimethyl phosphine oxide.

Particularly preferred surfactants include also the anionic surfactants. Suitable anionic surfactants for use herein include alkali metal (e.g., sodium or potassium) fatty acids, or soaps thereof, containing from about 8 to about 24, preferably from about 10 to about 20 carbon atoms.

The fatty acids including those used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process). Alkali metal soaps can be made by direct saponification of fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% C14, 29% C16, 23% C18, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties. When the term "coconut" is used herein it refers to fatty acid mixtures which typically have an approximate carbon chain length distribution of about 8% C8, 7% C10, 48% C12, 17% C14, 9% C16, 2% C18, 7% oleic, and 2% linoleic (the first six fatty acids listed being saturated). Other sources having similar carbon chain length distribution such as palm kernel oil and babassu oil are included with the term coconut oil.

Other suitable anionic surfactants for use herein include water-soluble salts, particularly the alkali metal salts, of organic sulfuric reaction products having in the molecular structure an alkyl radical containing from about 8 to about 22 carbon atoms and a radical selected from the group consisting of sulfonic acid and sulfuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; the reaction product of fatty acids esterified with isothionic acid and neutralized with sodium hydroxide where, for example, the fatty acids are derived from coconut oil; sodium or potassium salts of fatty acid amide of a methyl taurine in which the fatty acids, for example, are derived from coconut oil; and others known in the art, a number being specifically set forth in U.S. Pat. Nos. 2,486,921, 2,486,922 and 2,396,278, incorporated herein by reference.

Suitable zwitterionic detergents to be used herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred zwitterionic detergent compounds have the formula

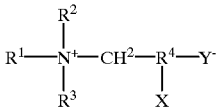

wherein R1 is an alkyl radical containing from about 8 to about 22 carbon atoms, R2 and R3 contain from 1 to 3 carbon atoms, R4 is an alkylene chain containing from 1 to about 3 carbon atoms, X is selected from the group consisting of hydrogen and a hydroxyl radical, Y is selected from the group consisting of carboxyl and sulfonyl radicals and wherein the sum of R1, R2 and R3 radicals is from about 14 to about 24 carbon atoms.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon's Detergents and Emulsifiers, North American Ed. 1980, incorporated herein by reference.

The compositions according to the present invention are liquid hard-surface cleaning compositions. The liquid compositions of the present invention are preferably but not necessarily formulated as aqueous compositions. Aqueous compositions typically comprise from 50% to 98% by weight of the total composition of water, preferably from 60% to 95%, and more preferably from 80% to 95%.

The compositions according to the present invention have a pH of from 6 to 13, preferably of from 6.5 to 12, and more preferably of from 7 to 11. The pH of the compositions herein can be adjusted by any of the means well-known to the man skilled in the art such as addition of NaOH, KOH, K2CO3, Na2CO3 and the like.

The compositions herein can further comprise a variety of optional ingredients. Suitable optional ingredients for use herein include builders, chelants, solvents, buffers, bactericides, hydrotropes, colorants, stabilizers and/or perfumes.

Suitable perfumes to be used herein include materials which provide an olfactory aesthetic benefit and/or cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the nonionic detergent surfactants. The perfume ingredients and compositions suitable to be used herein are the conventional ones known in the art. Selection of any perfume component, or amount of perfume, is based solely on aesthetic considerations.

Suitable perfume compounds and compositions can be found in the art including U.S. Pat. Nos. 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. In general, the degree of substantivity of a perfume is roughly proportional to the percentages of substantive perfume material used. Relatively substantive perfumes contain at least about 1%, preferably at least about 10%, substantive perfume materials. Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 and above, and are detectable at levels below those of the average perfume material. Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other C15H24 sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations.

The compositions herein may comprise a perfume ingredient, or mixtures thereof, in amounts up to 5.0% by weight of the total composition, preferably in amounts of 0.1% to 1.5%.

Another class of optional compounds are chelating agents such as those selected from the group of aminophosphonates. Suitable amino phosphonate compounds for use herein include amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred amino phosphonate chelant to be used herein is diethylene triamine penta methylene phosphonate. Such phosphonate chelant is commercially available from Monsanto under the trade name DEQUEST®.

Chelants can be incorporated in the compositions herein in amounts ranging from 0.0% to 10.0% by weight of the total composition, preferably 0.1% to 5.0%.

The present invention will be further illustrated by the following examples.

EXAMPLES

The following compositions were made by mixing the listed ingredients in the listed proportions. All proportions are % by weight of the total composition. These compositions were used neat and diluted to clean hard-surfaces like floors. Excellent cleaning performance and excellent gloss were delivered to the surfaces cleaned.

| Compositions (weight %) | 1 | 2 | 3 | 4 |
|---|---|---|---|---|
| C7/C9/C11 EO6.5 | 3.0 | 3.0 | 3.0 | 3.0 |
| C12/C13 EO3 | 1.0 | 1.0 | 1.0 | 1.0 |
| C13/C15 EO30 | 2.0 | 2.0 | 2.0 | 2.0 |
| Palm Kernal Fatty Acid | 0.4 | 0.4 | 0.4 | 0.4 |
| Perfume | 0.45 | 0.45 | 0.45 | 0.45 |
| Sokolan ® CP5* | 1.0 | 0 | 0 | 0 |
| Sokolan ® CP7** | 0 | 1.0 | 0 | 0 |
| Carboxymethyl cellulose | 0 | 0 | 1.0 | 0 |
| Primal ® B 924*** | 0 | 0 | 0 | 1.0 |
| CaCl2.2H20 | 1.0 | 1.0 | 1.0 | 1.0 |
| Water and minors | | up to 100% | | |
| pH | 10.5 | 10.5 | 10.5 | 10.5 |

*Maleic acid-acrylic acid copolymer (MW = 70 000)
**Polycarboxylate copolymer (MW = 50 000)
***Polyacrylate containing emulsion commercially available from Rohm and Haas.

* Maleic acid-acrylic acid copolymer (MW=70 000)
** Polycarboxylate copolymer (MW=50 000)
*** Polyacrylate containing emulsion commercially available from Rohm and Haas.

The molar ratio of said carboxylate-containing polymer to calcium ions in examples 1 to 3 is from 2.1:1 to 1.2:1.

| Compositions (weight %) | 5 | 6 | 7 | 8 | 9 | 10 | 11 |
|---|---|---|---|---|---|---|---|
| C7/C9/C11 EO6.5 | 3.0 | 3.0 | 3.0 | 3.0 | 3.0 | 0.0 | 0.0 |
| C12/C13 EO3 | 1.0 | 1.0 | 1.0 | 1.0 | 1.0 | 1.0 | 1.0 |
| C13/C15 EO30 | 2.0 | 2.0 | 2.0 | 2.0 | 2.0 | 4.0 | 4.0 |
| Palm Kernal Fatty Acid | 0.4 | 0.4 | 0.4 | 0.4 | 0.4 | 0.4 | 0.0 |
| Perfume | 0.45 | 0.45 | 0.45 | 0.45 | 0.45 | 0.3 | 0.3 |
| Sokolan CP5* | 1.0 | 1.0 | 1.0 | 1.0 | 3.0 | 0.5 | 0.5 |
| CaCl2.2H20 | 0.5 | 0 | 0 | 0.5 | 1.0 | 1.0 | 0.0 |
| MgSO4.7H20 | 0 | 1.68 | 0 | 0 | 0 | 0 | 0.5 |
| ZnCl2 | 0 | 0 | 0.93 | 0 | 0 | 0 | 0 |
| Water and minors | up to 100% | | | | | | |
| pH | 10.5 | 10.5 | 10.5 | 10.5 | 10.5 | 10.5 | 10.5 |

*Maleic acid-acrylic acid copolymer (MW = 70 000)

* Maleic acid-acrylic acid copolymer (MW=70,000)

The molar ratio of said carboxylate-containing polymer to said divalent ions in examples 5 and 8 is from 4.2:1 to 2.4:1, in examples 6 and 7 is from 2.1:1 to 1.2:1, in example 9 is from 6.3:1 to 3.6:1, in example 10 is from 1.1:1 to 1:1.7, and from 3.5:1 to 2.1:1 in example 11.

What is claimed is:

1. A process of cleaning glossy surfaces other than dishes and cleaning utensils, said surfaces selected from the group consisting of glazed ceramic tile, vinyl linoleum and melamine, by applying to said surfaces an aqueous composition comprising:

a) a carboxylate-containing polymer selected from the group consisting of cellulose derivatives, homopolymers of carboxylic acids and copolymers of different carboxylic acids, b) from 0.1% to 50% of a surfactant, and c) a divalent counterion, wherein the molar ratio of carboxylate containing monomer in said polymer to said divalent counterion is from 12:1 to 1:32 and wherein said composition is free of proteolytic or amylolytic enzymes.

2. A process according to claim 1 wherein said composition is applied onto said surfaces after having been diluted with water.

3. A process according to claim 2 wherein said surfaces are not rinsed after said composition has been applied.

4. A process according to claim 1 wherein said composition has a pH of from about 6 to about 13.

5. A process according to claim 1 wherein said carboxylate-containing polymer is selected from the group consisting of cellulose derivatives and homopolymers of acrylic acid, homopolymers of maleic acid, homopolymers of maleic anhydride and copolymers of acrylic acid with maleic acid or maleic anhydride; and mixtures thereof.

6. A process according to claim 1 wherein said carboxylate-containing polymer is selected from the group consisting of carboxymethylcellulose an acrylic acid-based polymer with an average molecular weight in its acidic form of from about 2,000 to about 1 000 000, and an acrylic/maleic based copolymer wherein the ratio of acrylate to maleate monomers ranges from about 30:1 to about 1:1 with an average molecular weight of from about 2000 to about 100 000, and mixtures thereof.

7. A process according to claim 1 wherein said divalent counterion is added in the form of a salt selected from the group consisting of salts of calcium, zinc, cadmium, nickel, copper, cobalt, zirconium, chromium, magnesium, and mixtures thereof.

8. A process according to claim 1 wherein said molar ratio is from about 8:1 to about 1:16.

9. A process according to claim 8 wherein said molar ratio is from about 6:1 to about 1:12.

10. A process according to claim 8 wherein said molar ratio is from about 4:1 to about 1:6.

11. The process of claim 7 wherein said salt is selected from the group consisting of calcium chloride, magnesium chloride, zinc chloride and mixtures thereof.

12. A process according to claim 1 wherein said composition further comprises an ingredient selected from the group consisting of perfumes, chelating agents, builders, solvents, buffers, bactericides, hydrotropes, colorants, and mixtures thereof.

13. A process according to claim 1 wherein said surfactant is selected from the group consisting of nonionic surfactants, anionic surfactants, zwitterionic surfactants, amphoteric surfactants, cationic surfactants and mixtures thereof.

14. The process of claim 13 wherein the surfactant is a nonionic surfactant or mixture of nonionic surfactants.

15. A process according to claim 1 wherein said composition comprises from about 0.1% to about 20% of the total composition of said surfactant or mixtures thereof.

16. A process according to claim 15 wherein said composition comprises from about 1% to about 10% of the total composition of said surfactant or mixtures thereof.

17. An aqueous liquid hard surface cleaning composition comprising a) a carboxylate-containing polymer selected from the group consisting of cellulose derivatives, homopolymers of carboxylic acids and copolymers of different carboxylic acids, b) from 0.1% to 50% of a surfactant selected from the group consisting of cationic, amphoteric and zwitterionic surfactants and mixtures thereof, c) a divalent counterion, and d) from 50% to 98% water wherein the molar ratio of carboxylic containing monomer in said polymer to said divalent counterion is from 12:1 to 1:32 and wherein said composition is free of proteolytic or amylolytic enzymes and free of polyhydroxy fatty acid amide.

18. A composition according to claim 17 wherein said composition is an aqueous liquid composition having a pH of from about 6 to about 13.

19. A composition according to claim 18 wherein said composition has a pH of from about 6.5 to about 12.

20. A composition according to claim 18 wherein said composition has a pH of from about 7 to about 11.

21. A composition according to claim 17 wherein said carboxylate-containing polymer is selected from the group consisting of cellulose derivatives, homopolymers of acrylic acid, homopolymers of maleic acid, homopolymers of maleic anhydride and copolymers of maleic acid or maleic anhydride with acrylic acid and mixtures thereof.

22. A composition according to claim 17 wherein said carboxylate-containing polymer is selected from the group consisting of carboxymethylcellulose an acrylic acid-based polymer with an average molecular weight in its acidic from of from about 2 000 to about 1 000 000, and an acrylic/maleic based copolymer wherein the ratio of acrylate to maleate monomers ranges from about 30:1 to about 1:1 with an average molecular weight of from about 2000 to about 100 000, and mixtures thereof.

23. A composition according to claim 17 wherein said divalent counterion is added in the form of a salt selected from the group consisting of salts of calcium, zinc, cadmium, nickel, copper, cobalt, zirconium, chromium, magnesium, and mixtures thereof.

24. The composition of claim 23 wherein said salt is selected from the group consisting of calcium chloride, magnesium chloride, zinc chloride and mixtures thereof.

25. A composition according to claim 17 wherein said molar ratio is from about 8:1 to about 1:16.

26. A composition according to claim 25 wherein said molar ratio is from about 6:1 to about 1:12.

27. A composition according to claim 25 wherein said molar ratio is from about 4:1 to about 1:6.

28. A composition according to claim 17 wherein said composition further comprises an ingredient selected from the group consisting of perfumes, chelating agents, builders, solvents, buffers, bactericides, hydrotropes, colorants, and mixtures thereof.

29. A composition according to claim 17 wherein said composition comprises from about 0.1% to about 20% of the total composition of said surfactant or mixtures thereof.

30. A composition according to claim 29 wherein said composition comprises from about 1% to about 10% of the total composition of said surfactant or mixtures thereof.

* * * * *